US005495723A

United States Patent [19]

MacDonald

[11] Patent Number: 5,495,723

[45] Date of Patent: Mar. 5, 1996

[54] CONVERTIBLE AIR CONDITIONING UNIT USABLE AS WATER HEATER

[76] Inventor: Kenneth MacDonald, R.R. #1, 11753 Trafalgar Road, Georgetown, Ontario, Canada

[21] Appl. No.: 322,931

[22] Filed: Oct. 13, 1994

[51] Int. Cl.[6] ..... F25B 39/04

[52] U.S. Cl. ..... 62/183; 62/238.6; 62/238.7

[58] Field of Search ..... 62/183, 184, 238.6, 62/238.7

[56] References Cited

U.S. PATENT DOCUMENTS

| | | | |
|---|---|---|---|
| 2,700,279 | 1/1955 | Stickel | 62/183 X |
| 3,017,162 | 1/1962 | Haines et al. | 62/183 X |
| 3,188,829 | 6/1965 | Siewert et al. | 62/183 X |
| 3,498,072 | 3/1970 | Stiefel | 62/238.6 |
| 4,168,745 | 9/1979 | Lastinger | 165/164 |
| 4,279,128 | 7/1981 | Leniger | 62/238.6 |
| 4,386,500 | 6/1983 | Sigafoose | 62/79 |
| 4,513,580 | 4/1985 | Cooper | 62/183 |
| 4,588,026 | 5/1986 | Hapgood | 165/158 |
| 4,907,418 | 3/1990 | DeFazio | 62/238.6 |
| 5,054,542 | 10/1991 | Young et al. | 165/58 |
| 5,184,472 | 2/1993 | Guilbault et al. | 62/160 |

OTHER PUBLICATIONS

Christopher Guly, "Cool Comfort", *Homes & Cottages*, 1994, pp. 25 and 27.

*Primary Examiner*—William E. Tapolcai
*Attorney, Agent, or Firm*—Barry R. Lipsitz

[57] ABSTRACT

An improvement for converting an air conditioner or heat pump system into a water supply heater, including a water cooled condenser having a refrigerant throughflow passageway and a water throughflow conduit for bringing a water supply pumped therethrough into heat exchange relationship with the refrigerant. A three-way valve connects the compressor to the water-cooled condenser or to an exterior heat exchanger in the air conditioner, or a reversing valve in the heat pump. Control system including a water pressure switch for actuating the three-way valve, a refrigerant pressure activated water regulator valve mounted on the inflow side of the water throughflow conduit, and a thermostat, route refrigerant via the three-way valve to the water cooled condenser only when a water supply is desired to be heated, thereby preventing the build-up of scale in the condenser water conduits. The control system also switches off the fan of the exterior heat exchanger when the water-cooled condenser is in use.

20 Claims, 6 Drawing Sheets

| HEAT/COOL DEMAND | WATER PRESS. SWITCH | WATER TEMP. | REFRIGERANT PRESS. | MODE | REVERSING VALVE | THREE-WAY VALVE | INTERIOR FAN | EXTERIOR FAN |
|---|---|---|---|---|---|---|---|---|
| COOL | ON | LOW | GOOD | SPACE COOLING & WATER SUPPLY HEATING | OFF | WATER | ON | OFF |
| COOL | OFF | N/A | GOOD | SPACE COOLING WITHOUT WATER SUPPLY HEATING | OFF | AIR | ON | ON |
| HEAT | ON | LOW | GOOD | SPACE HEATING & WATER SUPPLY HEATING | ON | WATER | ON | ON |
| HEAT | OFF | N/A | GOOD | SPACE HEATING WITHOUT WATER SUPPLY HEATING | ON | AIR | ON | ON |
| NOT COOL AND NOT HEAT | ON | LOW | GOOD | WATER SUPPLY HEATING WITHOUT INTERIOR SPACE HEATING OR COOLING | ON | WATER | OFF | ON |
| N/A | N/A | N/A | LOW | SHUTDOWN | N/A | AIR | OFF | OFF |

FIG. 5

CONVERTIBLE AIR CONDITIONING UNIT USABLE AS WATER HEATER

BACKGROUND OF THE INVENTION

The present invention relates to the field of heat exchange systems and more particularly, to heat exchange systems which utilize waste heat from conventional refrigeration circuits to heat a water supply or other liquid source.

Air conditioners and/or heat pumps, which are typically installed in a wide variety of residential dwellings and commercial establishments, tend to consume a substantial amount of energy relative to other typical appliances found in such premises.

A typical air conditioner circuit includes, in the following order, a compressor from which a heat carrier fluid, such as refrigerant, flows from an outlet thereof; an outdoor heat exchanger typically including an outdoor condenser wherein the refrigerant flows and an electric fan for blowing external air over condenser coils thereby causing the refrigerant to be in heat exchanger relationship with the external environment; an evaporator or other refrigerant expansion device; and an indoor heat exchanger comprising an indoor coil and an electric fan for circulating the interior air over the coil thereby bringing the interior air into heat exchange relationship with the refrigerant flowing through the coil. In the air conditioner, heat from the interior environment is absorbed by cooled refrigerant via the indoor heat exchanger and typically this "waste" heat is dissipated to the external environment by the outdoor heat exchanger.

In a heat pump, a reversing valve is connected to the compressor outlet in the above circuit so that the refrigerant flow outlined above may be reversed, as desired. When the heat pump is in a heating mode, the outdoor heat exchanger absorbs heat from the external environment and the indoor heat exchanger dissipates heat to the interior environment. When the heat pump is in an air conditioning mode, the reverse occurs, as described above.

There are many apparatus disclosed in the prior art which seek to utilize the waste heat generated by the typical air conditioner or heat pump in order to heat a water supply, such as water from a swimming pool or the hot water supply of a dwelling. By doing so, water heating energy costs are lowered and a valuable resource is conserved.

U.S. Pat. No. 3,498,072 issued Mar. 3, 1970 to R. C. Stiefel discloses a method by which the heat rejected from a water cooled heat pump may be utilized to heat the water of a swimming pool, including the step of using the swimming pool recirculating system to circulate the swimming pool water through the cooling jacket of the condenser of the heat pump.

U.S. Pat. No. 4,168,745 issued Sep. 25, 1979 to The American Equipment Systems Corporation discloses a heat exchanger comprising a refrigerator tube in coil form leading from the output side of a compressor and a water tube in coil form tapped from a source of water to be heated, the tubes being coiled together so that each coil of the water tube is interposed between a coil of the refrigerant tube, and vice versa. Inner and outer cylindrical sleeves are disposed within and around the coiled tubes thereby defining an annulus which enhances the heat transfer from the refrigerant tube to the water tube. A housing surrounds the coiled tubes and the sleeves, and sealed end caps are provided at each end of the exchanger.

U.S. Pat. No. 4,588,026 issued May 13, 1986 to Raytheon Company discloses a heat exchanger comprising a bundle of flexible tubes extended longitudinally and asymmetrically through a flexible tubing of larger diameter to form a tube-in-tube assembly which is wound helically into a coil of desired size. Opposing end portions of the coil are provided with suitable fittings for permitting independent connection of the outer tubing to one fluid source and the bundle of flexible tubes to another fluid source.

U.S. Pat. No. 4,907,418 issued Mar. 13, 1990 to Louis DeFrazio describes a swimming pool heating system wherein the refrigerant from an air conditioner is used to heat the pool water. The heat exchange occurs in a sealed tank which contains a central perforated cylinder through which the pool water flows and a refrigerant cooling coil that extends about the central cylinder. Warmed refrigerant from the air conditioner is caused to flow through the refrigerant cooling coil in the sealed tank.

U.S. Pat. No. 5,184,472 issued Feb. 9, 1993 to Pierre Guilbault et al. discloses an "add-on a heat pump" swimming pool heater comprising a refrigerant-to-water heat exchanger with a water flow control and associated piping, a water temperature control, a flow detecting device and a specialized control logic which is integrated to the heat pump control. The heat exchanger is connected on the refrigerant side to the outlet of the compressor of the heat pump circuit and to the inlet of the reversing valve.

One drawback with the swimming pool water heating systems described above is that the add-on water-refrigerant heat exchanger is usually installed between the outlet of the compressor and the external heat exchanger. Thus, the refrigerant is always pumped to flow through piping of the water-refrigerant heat exchanger, even when the pool water heating system is not operating and warmed refrigerant is cooled by the conventional fan-forced, air-cooled condenser of the air conditioner or heat pump. Hence, considering that the pool water does not circulate in the water-refrigerant heat exchanger but hot refrigerant does flow therethrough, any residual water located within the water-refrigerant heat exchanger will be heated to possibly very high temperatures. Such heating may cause scale, e.g. calcium carbonate and the like, to form on the heat exchanger pipes which will eventually cause them to clog.

In addition when a reversible heat pump is employed as the pool water heating source, as described in U.S. Pat. No. 5,184,472, in the heating mode, refrigerant must flow through the pool water-refrigerant heat exchanger, thereby unnecessarily heating the pool water and reducing the efficiency of the heat pump to warm the interior environment. Even in heat pump systems where the water is not flowing through the heat exchanger, heat will still be lost to the outdoor environment as evidenced by the fact that such units melt the snow around them.

Accordingly, means are sought for an improved refrigerant circuit to alleviate the deficiencies in the prior art.

It is an object of the present invention to provide an improved refrigerant circuit for an air conditioner or heat pump with water heating functions which avoids the deficiencies in the prior art.

SUMMARY OF THE INVENTION

According to one aspect of the invention, there is provided in an air condition system including, in operative combination, a compressor having an inlet and outlet from which flows refrigerant, a fan-forced air-cooled exterior heat exchanger for bringing refrigerant into a heat exchange relationship with an exterior environment and dissipating heat thereto, a fan-forced indoor heat exchanger for bringing refrigerant into heat exchange relationship with an interior environment and accepting heat therefrom, an improvement for converting said system into a water supply heater comprising a water cooled condenser having a refrigerant throughflow passageway and a water throughflow conduit for bringing a water supply pumped therethrough into heat exchange relationship with said refrigerant; a directional three-way valve for connecting the compressor outlet to an inlet of said exterior heat exchanger and to an inlet of said water cooled condenser, said air cooled exterior heat exchanger and said water cooled condenser being connected at their outlets to said indoor heat exchanger; and control means for selectively directing said three-way valve to route the refrigerant either through said water cooled condenser in a water supply heating mode or through said air-cooled exterior heat exchanger but not through both said water cooled condenser and said air cooled heat exchanger at the same time.

According to another aspect of the invention, there is provided a heat pump system including, in operative combination, a compressor having an inlet and outlet from which flows a refrigerant, a reversing valve, a fan-forced exterior heat exchanger for bringing the refrigerant into heat exchange relationship with an exterior environment, a fan-forced interior heat exchanger for bringing the refrigerant into heat exchange relationship with an interior environment, a refrigerant accumulator connected to the inlet of said compressor, a water cooled condenser having a refrigerant throughflow passageway and a water throughflow conduit for bringing a water supply pumped therethrough into heat exchange relationship with said refrigerant; a directional three-way valve for connecting the compressor outlet to an inlet of said water cooled condenser and to an inlet of said reversing valve, an outlet of said water cooled condenser being also connected to said reversing valve; and control means for operating said heat pump system including actuating the fan of said interior heat exchanger and the fan of said exterior heat exchanger in accordance with various heat pump operating modes and selectively directing said three-way valve to route the refrigerant either through said water cooled condenser in a water supply heating mode, or through said reversing valve and said exterior heat exchanger but not through both said water cooled condenser and said exterior heat exchanger at the same time.

In cool weather, the present invention will avoid undesired heat lost to the outdoors at the water cooled condenser because no refrigerant flows through it, unless desired for selected operation.

In a water heating mode of operation, it is possible with a preferred embodiment of the invention to absorb heat from the outdoors and to use this heat to heat up the water pumped through the unit.

In the foregoing manner, the three-way valve is installed such that refrigerant is routed to the water cooled condenser only when required, thereby avoiding the overheating of residual water in the water cooled condenser and attendant formation of scale therein and the possible premature failure of the water cooled condenser.

BRIEF DESCRIPTION OF THE DRAWINGS

The present invention will be understood and appreciated more fully from the following detailed description taken in conjunction with the drawings in which:

FIG. 5 is a table detailing the operating modes of the system shown in FIG. 3.

DETAILED DESCRIPTION OF PREFERRED EMBODIMENTS

The "waste" heat from a typical air conditioner or heat pump may be directed to heat a water supply such as a swimming pool or hot water supply of a residential dwelling or other commercial establishment (hereinafter "dwelling"), instead of ejecting such heat into the external environment. The heat exchange circuit of the present invention may be employed in a typical air conditioner to provide a water supply heating feature or in a typical heat pump to provide a water supply heating feature. Employing the waste heat in such manner with the present invention will result in lower overall heating and operating costs compared to employing a separate heater for heating the water supply. These lower costs are due in part to the fact that the outdoor fan of the air conditioner or heat pump is normally turned off during pool heating.

Figure 1:
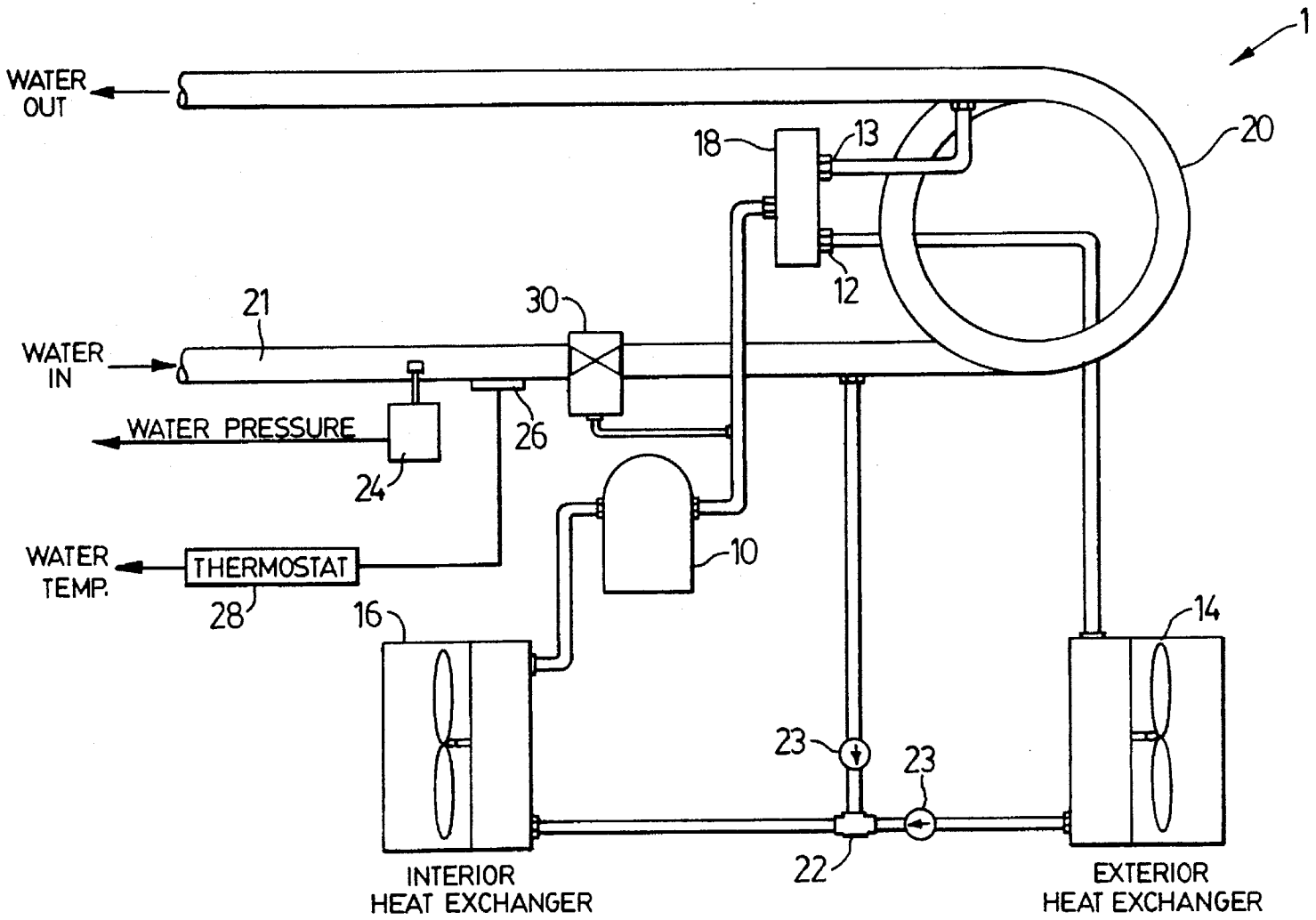
FIG. 1 is a schematic diagram partially in block form, of a heat exchange circuit which provides an air conditioning—water supply heating system, in accordance with one embodiment of the present invention.

FIG. 1 depicts a heat exchange circuit for a composite air conditioning—water supply heating system 1 in accordance with one embodiment of the present invention. The system 1 includes a conventional air conditioner refrigeration circuit comprising, in operative combination, a compressor 10, an outdoor fan-forced air cooled heat exchanger or condenser 14 for bringing refrigerant into heat exchange relationship with the external environment and dissipating heat thereto, and a fan-forced indoor heat exchanger or evaporator 16 for bringing refrigerant into heat exchange relationship with the interior environment and accepting heat therefrom.

In accordance with a preferred embodiment of the present invention, a directional three-way solenoid valve 18, such as ALCO Controls, Model No. 4031RDBF55, is installed between the compressor 10 and outdoor heat exchanger 14. One outlet 12 from the three-way valve 18 connects to the heat exchanger 14 thereto via conventional refrigerant conduit. The other outlet 13 from the three-way valve 18 is connected to a water cooled condenser 20 via appropriate refrigerant conduit. In a preferred embodiment, the condenser 20 is of the coaxial coil variety with the smaller refrigerant pipe running through the center of the larger exterior water pipe. The outdoor heat exchanger 14 and water cooled condenser 20 are connected back into the refrigerant circuit by way of a T-connector or Y-connector 22 which serves to join the branches thereof into a single refrigerant conduit that leads to the indoor heat exchanger 16. If desired, a one way or check valve 23 may be installed in either or both of the refrigerant conduit branches leading to the Y-connector to prevent any possible reverse flow therein.

The water cooled condenser 20 may be any conventional condenser having a refrigerant throughflow coil and a water throughflow conduit for bringing the water supply pumped therethrough into heat exchange relationship with the refrigerant as is known per se in the art. The above-mentioned coaxial coil type of condenser is available from Doucette Industries, such as their CX-H-200 which is a 2 ton unit (other sizes are also available with different heat exchanging capacities).

The solenoid-activated three-way valve 18 is de-activated by associated control means in order to shunt refrigerant to the water-cooled condenser 20 when the system 1 is in a space cooling combined with water supply heating mode and is activated for shunting refrigerant to the outdoor heat exchanger 14 when the system 1 is in a space cooling without water supply heating mode. Preferably, the control means include a water pressure switch 24 for sensing inflow water pressure in the water cooled condenser 20, a remote bulb thermostat 28 responsive to water supply temperature, and a water regulator valve 30 for controlling water flow through the condenser 20 in order to optimize refrigerant pressure.

To begin heating the water supply (assuming the air conditioner is activated), a operator preferably activates a pump, or opens a valve from a water supply line, or performs some other means for causing water to be pumped into the inflow conduit of the condenser 20. The water pressure switch 24, which is connected to the inflow conduit 21 of the water cooled condenser 20, is engaged when the inflow water pressure therein exceeds a minimum pressure level. When engaged and provided the temperature of the water has not already reached the required level, the switch 24 de-activates the three-way valve 18 to route refrigerant from the compressor 10 to the water cooled condenser 20 and de-energizes the fan associated with the outdoor heat exchanger 14, whereby waste heat from the heat exchange circuit 1 is absorbed by the water supply such as the swimming pool. In the event the switch 24 is disengaged due to insufficient water pressure for whatever reason, such as shutting off the water inflow, such disengagement actuates the three-way valve 18 to route refrigerant from the compressor 10 to the outdoor heat exchanger 14 and energizes the fan associated therewith in order to operate the system 1 in the space cooling without water supply heating mode.

A temperature sensor 26 of the thermostat 28 is connected to the inflow conduit 21 of the water cooled condenser 20 to sense the temperature of the water flowing therein. When the temperature of the water reaches a threshold temperature level, the water supply does not require further heating, so the thermostat 28 actuates the three-way valve 18 to route refrigerant from the compressor 10 to the outdoor heat exchanger 14 and energizes the fan associated therewith, whereby the system 1 operates in the space cooling without water supply heating mode. Note that only when both the water pressure switch 24 senses the required water pressure and the thermostat 28 senses a need for heating the water will both these switches open to de-activate the three-way valve 18 to route refrigerant to the condenser 20 and de-energize the fan motor of heat exchanger 14.

In addition, the refrigerant pressure activated water regulator valve 30, which is mounted in the inflow conduit 21 regulates the amount of water flowing through the condenser 20 in order to ensure the optimum refrigerant pressure and maintain this pressure at the desired level. Cold water will flow more slowly as less is required while warmer water will flow at a greater rate through the condenser 20.

It will be appreciated that in the system 1, if water pressure falls below the predetermined minimum level, the air conditioning system 1 will continue to operate with the outdoor heat exchanger 14 operative to cool heated refrigerant.

Moreover, in the present invention, as the water cooled condenser 20 is installed in parallel to, i.e. not in series with the fan-forced, air-cooled exterior heat exchanger 14, refrigerant flows through only the heat exchanger 14 or only through the condenser 20, but does not flow through both simultaneously, thereby avoiding the loss of heat to an undesired environment. More importantly, when system 1 is in the space cooling without water supply heating mode, the structure thereof prevents hot refrigerant from circulating within the coils of condenser 20 and heating any non-circulating residual water remaining within the condenser 20, which heating may cause scale, e.g. calcium carbonate and the like, to form in condenser water conduits that may eventually clog as a result thereof. Also, excessive heating of water in the condenser can result in its premature failure because its pipes are also overheated.

Figure 2:
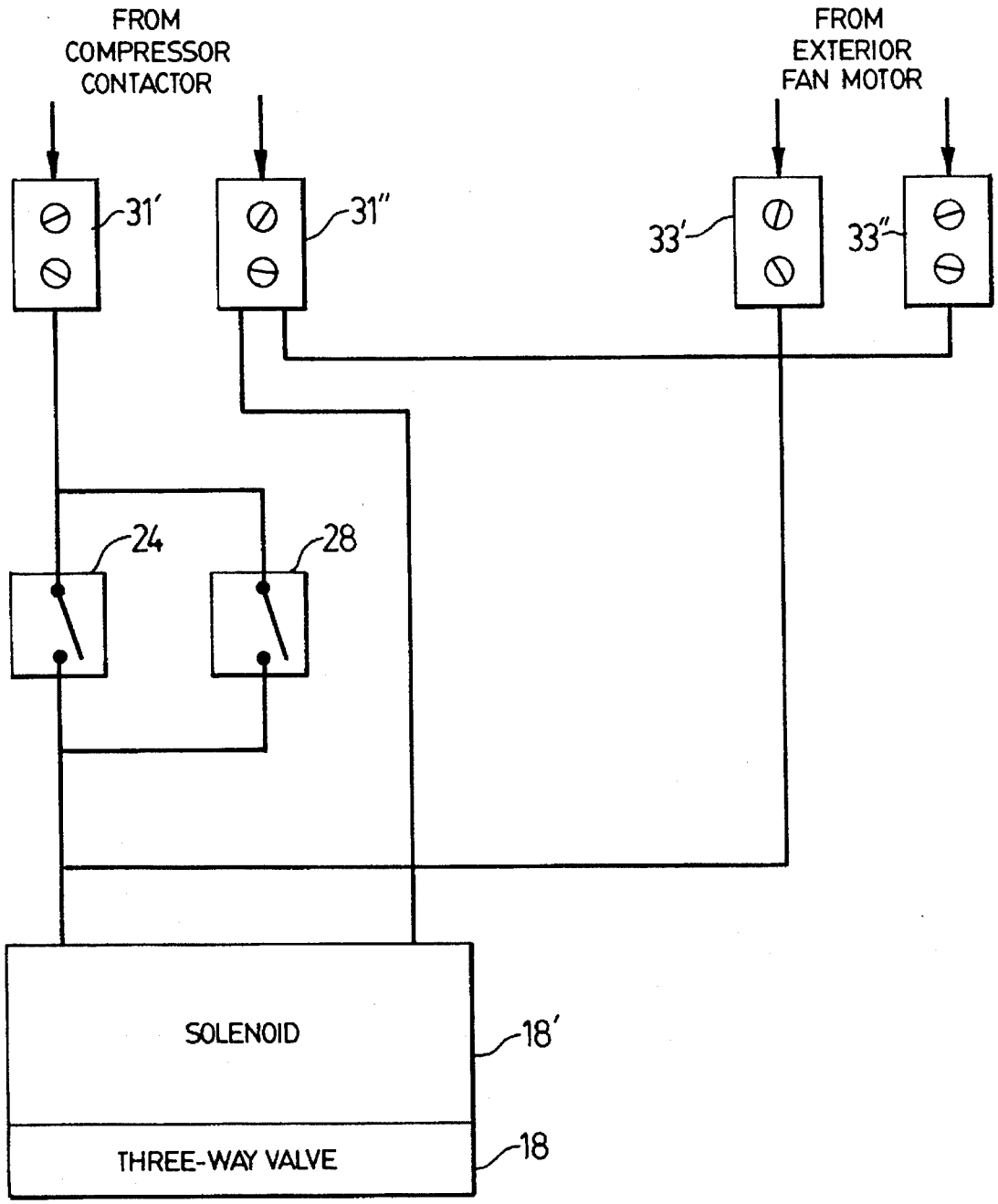
FIG. 2 is a wiring diagram for the system shown in FIG. 1.

FIG. 2 depicts a wiring diagram for the system 1 described above. Terminal blocks 31', 31" receive wires from the load side of a compressor contractor 10' (see FIG. 4). The normally closed water pressure switch 24 and normally open thermostat 28 are connected in parallel between terminal block 31' and one terminal of a solenoid 18" belonging to the three-way valve 18. The other terminal of the solenoid 18' is wired back to terminal block 31". Wires from the exterior fan motor (not shown) are connected to a thermal block 33', 33" which terminals are connected as shown in FIG. 2 to the three-way valve solenoid 18' and the compressor contactor 10'.

It will thus be seen from the aforementioned electrical circuit that water pressure will open the normally closed switch 24 and de-energize the three-way valve 18 and the exterior fan thereby enabling the water supply heating feature. The normally open thermostat 28 will close on a rise in water temperature surpassing the threshold level thereby energizing the three-way valve 18' and the exterior fan, and thus disabling the water supply heating feature.

Figure 3:
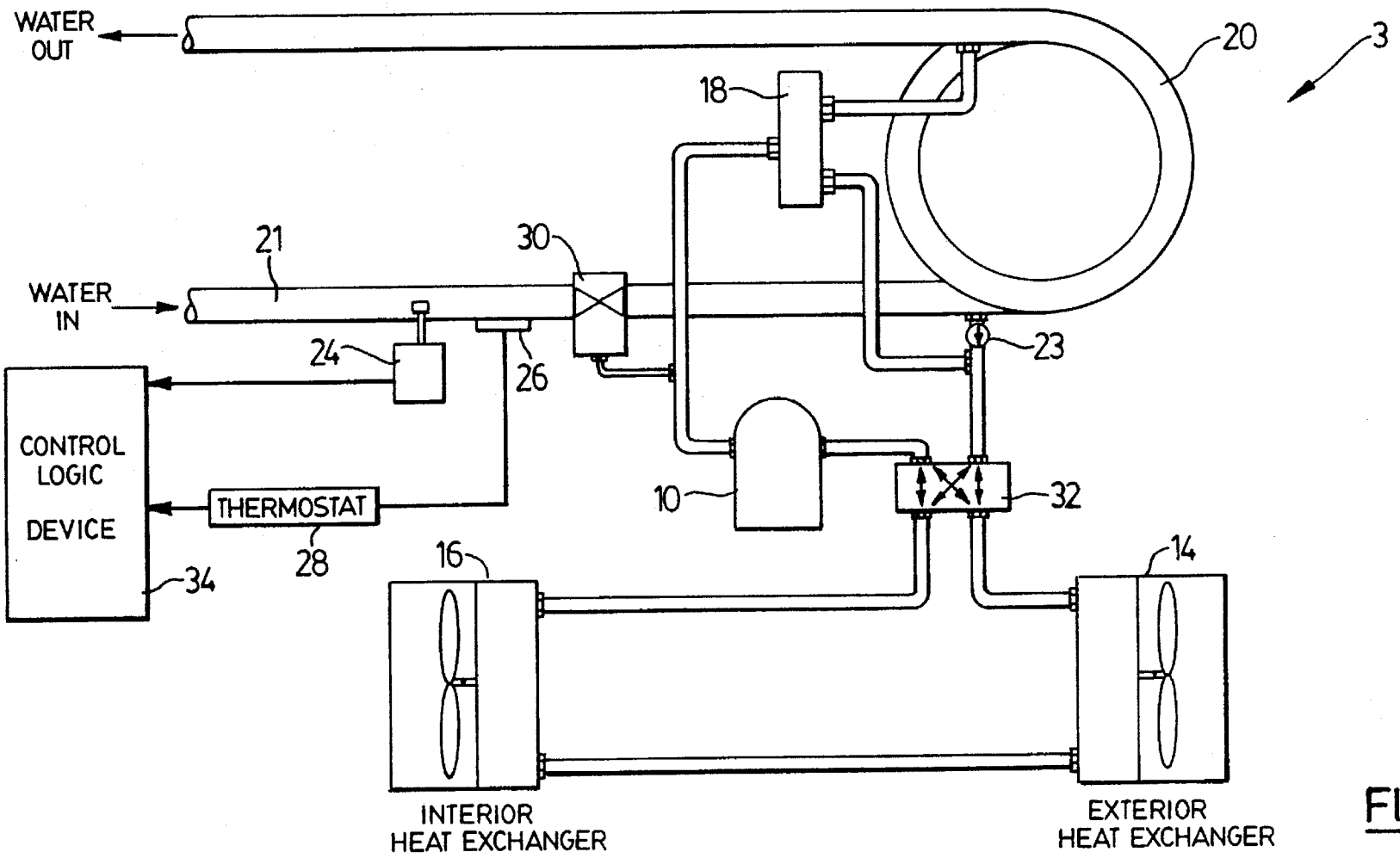
FIG. 3 is a schematic diagram, partially in block form, of a heat exchange circuit which provides a heat pump—water supply heating system, in accordance with another embodiment of the present invention.

FIG. 3 depicts a heat exchange circuit for a composite heat pump—water supply heater system 3 in accordance with another embodiment of the present invention. The system 3 includes a conventional heat pump circuit very similar to the conventional refrigerant circuit depicted in FIG. 1 except for the inclusion of a reversing valve 32 which, as is well known in the art, functions to reverse refrigerant flow so that interior space heating is possible as well as interior space cooling.

In accordance with this embodiment of the invention, the water cooled condenser 20 and three-way valve 18 are installed in system 3 between the compressor 10 and reversing valve 32, the three-way valve 18 serving to route refrigerant through the condenser 20 or to bypass it altogether.

Figure 4:
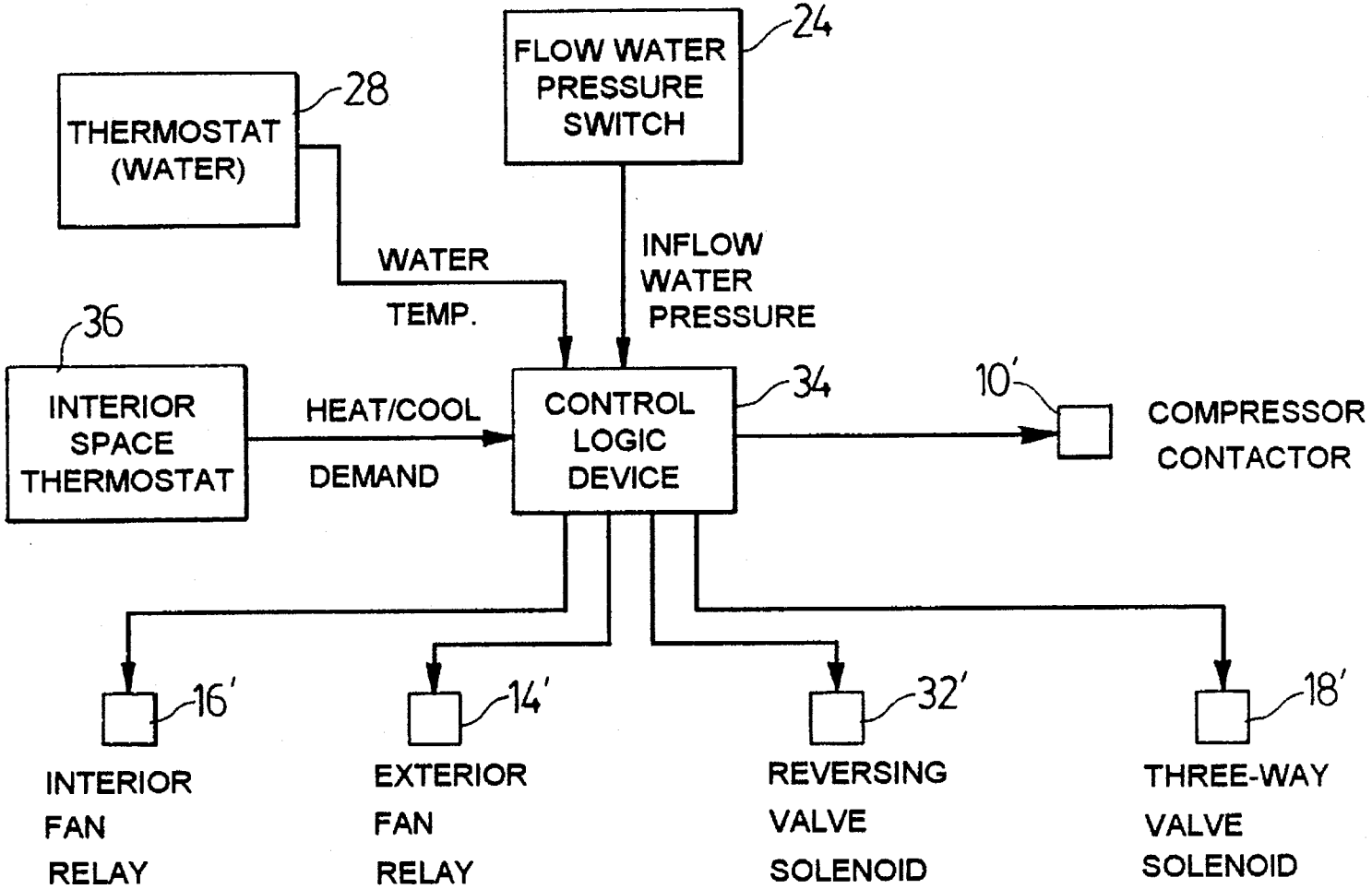
FIG. 4 is a schematic block diagram of a control device for the system shown in FIG. 3.

Referring to FIGS. 4 and 5, a control device 34 receives a cooling/heating demand signal from an interior space thermostat 36 typically associated with heat pumps, a water temperature signal from the water temperature thermostat 28, and a water pressure signal from the water pressure switch 24. Based upon these signals, the control device 34 determines the operating mode for the system 3 and energizes the compressor contact 10', the three way valve solenoid 18', a reversing valve relay 32', and interior and exterior fan relays 14', 16' respectively associated with the interior and exterior heat exchanger 14, 16 in accordance with said signals.

FIG. 5 tabulates the operating modes of the system 3, which include:

(a) a space cooling and water supply heating mode;

(b) a space cooling without water supply heating mode;

(c) a space heating and water heating mode;

(d) a space heating without water heating mode; and (e) a water supply heating without interior space heating or cooling mode.

Heat pump system 3 is similar to the air conditioning system 1 described above, in that, if the inflow water pressure to the condenser 20 is below a minimum level, or if the water temperature therein exceeds a threshold level, the control device 34 actuates the three-way valve 18 to route the refrigerant to bypass the condenser 20 (and consequently alters the operating mode), thereby avoiding the aforementioned problems of overheating water in the condenser 20. In addition, as in the air conditioning system 1, the refrigerant pressure activated valve 30 regulates the amount of water flow in order to ensure the optimum refrigerant pressure at all times during operation of the condenser.

Figure 6:
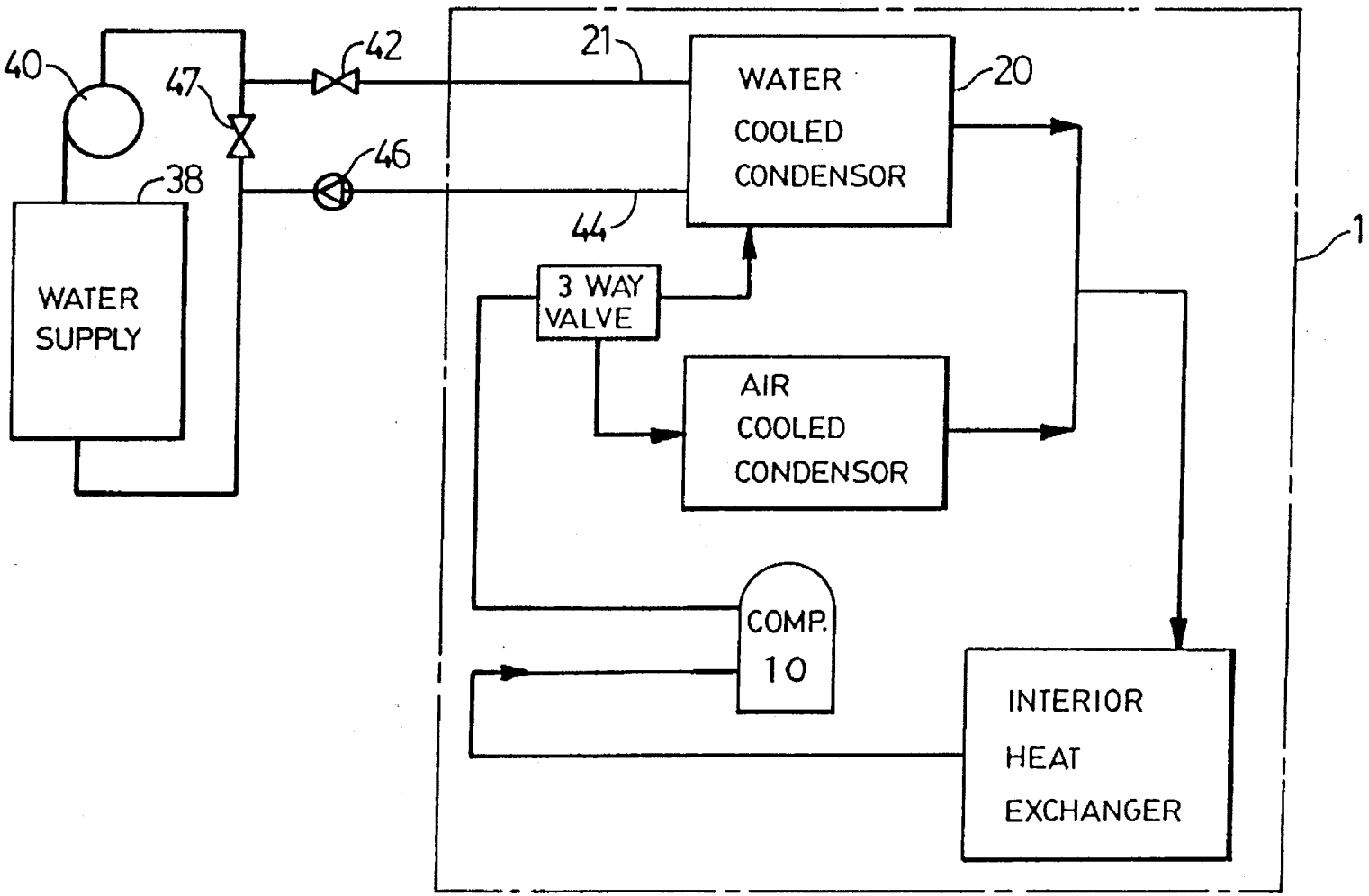
FIG. 6 is a schematic block diagram of a water source connected to either of the systems shown in FIGS. 1 and 3.

FIG. 6 shows, in block diagram form, how a water supply such as swimming pool 38 may be connected to either the air conditioning—water heating system 1 or the heat pump—water supply heating system 3 embodiments of the present invention. The pool 38 includes a pump and filter system 40 which functions to circulate swimming pool water as is known in the art. Preferably a valve 42 is opened to enable pool water to be pumped into the inflow conduit 21 of the condenser 20. In addition, the outflow conduit 44 of the condenser 20 preferably may include a one way check valve 46 such that water flow therethrough is only directed towards the water supply 38. Preferably a throttling valve 47 is mounted in a connecting pipe between the inlet and outlet to direct the desired amount of water through the condenser 20.

It will be appreciated by persons skilled in the art that the present invention is not limited by what has been particularly shown and described herein. Rather, the scope of the present invention is defined only by the claims which follow.

I therefore claim:

1. In an air conditioner system including, in operative combination, a compressor having an inlet and outlet from which flows refrigerant, a fan-forced air-cooled exterior heat exchanger for bringing refrigerant into a heat exchange relationship with an exterior environment, a fan-forced indoor heat exchanger for bringing refrigerant into heat exchange relationship with an interior environment, an improvement for converting said system into a water supply heater, comprising:

a water cooled condenser having a refrigerant throughflow passageway and a water throughflow conduit for bringing a water supply pumped therethrough into heat exchange relationship with said refrigerant;

a directional three-way valve for connecting the compressor outlet to an inlet of said exterior heat exchanger and to an inlet of said water cooled condenser, said air cooled exterior heat exchanger and said water cooled condenser being connected at their outlets to said indoor heat exchanger; and control means for selectively directing said three-way valve to route the refrigerant either through said water cooled condenser in a water supply heating mode or through said air-cooled exterior heat exchanger but not through both said water cooled condenser and said air cooled heat exchanger at the same time;

(i) said control means including a water pressure switch for actuating said three-way valve to route the refrigerant from said compressor to said water cooled condenser and de-energizing the fan associated with said air-cooled exterior heat exchanger in response to inflow water pressure in said water cooled condenser exceeding a minimum pressure level, whereby said water supply heating mode is engaged, (ii) a refrigerant pressure activated water regulator valve mounted on the inflow side of said water throughflow conduit for regulating the amount of water flowing through said water through flow conduit in order to maintain a desired level of refrigerant pressure, and (iii) a thermostat for actuating said three-way valve to route refrigerant from said compressor to said air-cooled exterior heat exchanger and energizing the fan associated therewith in response to the temperature of said water supply exceeding a threshold temperature level, whereby said water supply heating mode is disengaged.

2. The improved system of claim 1 wherein a throttle valve is installed in a conduit connected to said inlet of said water cooled condenser in order to provide means for adjusting the amount of water flowing through said water cooled condenser.

3. The improved system of claim 1 wherein a one way check valve is installed in an outflow conduit of said exterior heat exchanger.

4. The improved system of claim 1 wherein said water cooled condenser is a coaxial coil type.

5. The improved system of claim 4 wherein said air cooled exterior heat exchanger and said water cooled condenser are connected to the indoor heat exchanger by means of a Y connector.

6. In a heat exchange circuit including, in operative combination, a compressor having an inlet and an outlet from which flows refrigerant, a fan-forced air-cooled exterior heat exchanger for bringing refrigerant into heat exchange relationship with an exterior environment, a fan-forced interior heat exchanger for bringing refrigerant into heat exchanger relationship with an interior environment, an improvement for converting said circuit into a water supply heater, comprising:

a water-cooled condenser having a refrigerant throughflow passageway with a refrigerant outlet and a water throughflow conduit for bringing a water supply pumped therethrough into heat exchange relationship with said refrigerant;

a directional three-way valve for connecting the compressor outlet to an inlet of the exterior heat exchanger and to an inlet of the water-cooled condenser, said exterior heat exchanger being connected at its outlet to said interior heat exchanger and said water-cooled condenser being operatively connected at said refrigerant outlet to the circuit; and circuit control means for operating said heat exchange circuit, including (i) a water pressure switch for actuating said three-way valve to route refrigerant from said compressor outlet to said water-cooled condenser inlet and de-energizing the fan associated with said exterior heat exchanger in response to inflow water pressure in said water-cooled condenser exceeding a minimum pressure level, whereby a water supply heating mode is engaged, and (ii) a thermostat for actuating said three-way valve to route refrigerant from said compressor outlet to said air-cooled exterior heat exchanger and energizing the fan associated therewith in response to the temperature of said water supply exceeding a threshold temperature level, whereby the water supply heating mode is disengaged.

7. The improved circuit of claim 6 wherein said control means includes a refrigerant-pressure-activated water regulator valve mounted on the inflow side of said water throughflow conduit in order to maintain a desired level of refrigerant pressure.

8. The improved circuit of claim 7 wherein a throttle valve is installed in a conduit connected to said inlet of said water cooled condenser in order to provide means for adjusting the amount of water flowing through said water cooled condenser.

9. The improved circuit of claim 6 wherein the outlet of said exterior heat exchanger is connected to said indoor heat exchanger and the outlet of said water-cooled condenser is also connected to said indoor heat exchanger, such that the water-cooled condenser and exterior heat exchanger are connected in parallel in said circuit.

10. The improved circuit of claim 9 wherein a one-way check valve is installed in an outflow conduit of said exterior heat exchanger.

11. The improved circuit of claim 9 wherein a one-way check valve is installed in a refrigerant outflow conduit of said water-cooled condenser.

12. The improved circuit of claim 9 wherein said water cooled condenser is a coaxial coil type.

13. The improved circuit of claim 6 including a reversing valve operatively connected in said circuit for selectively reversing the flow of refrigerant therein.

14. The improved circuit of claim 13 wherein said water-cooled condenser and said exterior heat exchanger are connected in series in said circuit, said reversing valve being installed between the compressor and the interior heat exchanger and between the water-cooled condenser and exterior heat exchanger.

15. The improved circuit of claim 14 including a refrigerant-pressure-activated water regulator valve mounted on the inflow side of said water throughflow conduit for regulating the amount of water flowing through said water throughflow conduit in order to maintain a desired level of refrigerant pressure.

16. The improved circuit of claim 14 including a throttle valve installed in a conduit connected to said inlet of said water cooled condenser in order to provide means for adjusting the amount of water flowing through said water filled condenser.

17. The improved circuit of claim 14 wherein said circuit control means further include switching means for:

energizing the fan of said interior heat exchanger and de-energizing the fan of said exterior heat exchanger when said control means is set to an interior space cooling combined with water supply heating mode;

energizing the fan of said interior heat exchanger and energizing the fan of said exterior heat exchanger when said control means is set to an interior space cooling without water supply heating mode; and energizing the fan of said interior heat exchanger and energizing the fan of said exterior heat exchanger and actuating said reversing valve when said control means is set to an interior space heating mode without water supply heating mode.

18. The improved circuit of claim 17 wherein said switching means energizes said reversing valve and the fans of said interior and exterior heat exchangers when said control means is set to an interior space heating combined with water supply heating mode.

19. The improved circuit of claim 17 wherein said switching means energizes said reversing valve and the fan of said exterior heat exchanger when said control means is set to a water supply heating without interior space heating or cooling mode.

20. The improved circuit of claim 17 wherein said switching means energizes said reversing valve and the fan of said exterior heat exchanger when said control means is set to a water supply heating without interior space heating or cooling mode.

* * * * *